US007300225B2

(12) United States Patent
Musil

(10) Patent No.: US 7,300,225 B2
(45) Date of Patent: Nov. 27, 2007

(54) APPARATUS AND METHOD FOR HEATING ROAD BUILDING EQUIPMENT

(75) Inventor: Joseph E. Musil, Ely, IA (US)

(73) Assignee: Cedarapids, Inc., Cedar Rapids, IA (US)

( * ) Notice: Subject to any disclaimer, the term of this patent is extended or adjusted under 35 U.S.C. 154(b) by 249 days.

(21) Appl. No.: 10/906,958

(22) Filed: Mar. 14, 2005

(65) Prior Publication Data

US 2006/0204333 A1 Sep. 14, 2006

(51) Int. Cl.
*E01C 23/14* (2006.01)

(52) U.S. Cl. ..... 404/79; 404/83; 404/101; 404/108; 404/118

(58) Field of Classification Search ..... 404/77, 404/79, 95, 83, 101, 108, 118
See application file for complete search history.

(56) References Cited

U.S. PATENT DOCUMENTS 1,462,851 A * 7/1923 Cooper ..... 404/77
2,644,379 A * 7/1953 Lowe ..... 404/95
2,805,052 A 9/1957 Preeman
3,285,147 A * 11/1966 Gruvris ..... 404/84.05
3,905,587 A 9/1975 Preeman
4,011,023 A 3/1977 Cutler
4,103,350 A 7/1978 Brock et al.
4,379,653 A * 4/1983 Brown ..... 404/118
4,557,626 A * 12/1985 McKay et al. ..... 404/90
4,812,076 A * 3/1989 Yant ..... 404/108
4,818,139 A 4/1989 Brock et al.
4,928,890 A 5/1990 Swisher, Jr.
5,000,615 A 3/1991 Murray
5,015,120 A 5/1991 Brock et al.
5,100,277 A 3/1992 Musil
5,197,848 A 3/1993 Musil
5,261,738 A 11/1993 Brock
5,291,876 A 3/1994 Milstead
5,312,246 A 5/1994 Brock
5,320,426 A 6/1994 Keylon et al.
5,334,012 A 8/1994 Brock et al.
5,356,238 A 10/1994 Musil et al.
5,378,060 A 1/1995 Brock et al.
5,380,084 A 1/1995 Milstead
5,405,214 A 4/1995 Campbell
5,478,530 A 12/1995 Swanson
5,522,158 A 6/1996 Swanson
5,551,166 A 9/1996 Milstead
5,573,396 A 11/1996 Swanson
5,615,973 A 4/1997 Campbell
5,851,085 A 12/1998 Campbell
5,857,804 A 1/1999 Musil
5,868,522 A 2/1999 Campbell
5,873,653 A 2/1999 Paetzold
5,899,630 A 5/1999 Brock
5,988,935 A * 11/1999 Dillingham ..... 404/79

(Continued)

*Primary Examiner*—Raymond W Addie
(74) *Attorney, Agent, or Firm*—Simmons Perrine PLC

(57) ABSTRACT

A method and apparatus for heating hot mix asphalt (HMA), via collecting fumes from HMA while the HMA is on-board a vehicle and in motion within the vehicle, and igniting the HMA with engine exhaust and using the heat of combustion of the HMA to heat HMA, such as via the floor of a re-mix machine or paver which is capable of churning and mixing the HMA which increases emission of HMA fumes.

27 Claims, 7 Drawing Sheets

U.S. PATENT DOCUMENTS 6,007,272 A 12/1999 Macku
6,019,544 A 2/2000 Emerson et al.
6,071,040 A 6/2000 Macku et al.
6,099,205 A 8/2000 Macku et al.
6,109,826 A * 8/2000 Mertes ..... 404/95
6,318,928 B1 11/2001 Swearingen
6,371,689 B1 * 4/2002 Wiley ..... 404/77
6,560,817 B2 5/2003 Deiterman et al.
6,652,268 B1 11/2003 Irwin et al.
2004/0240939 A1 * 12/2004 Hays et al. ..... 404/95

* cited by examiner

APPARATUS AND METHOD FOR HEATING ROAD BUILDING EQUIPMENT

FIELD OF THE INVENTION

The present invention generally relates to road building and paving equipment, and more particularly relates to methods and apparatuses for heating surfaces of road building and paving equipment.

BACKGROUND OF THE INVENTION

In the past, road building and paving equipment designers have endeavored to improve the functionality of such equipment. U.S. Pat. No. 5,851,085 to Campbell shows a gravity-fed paver. This patent teaches the use of engine exhaust to the side of the hopper to facilitate flow of material through the gravity-fed hopper to the screed. Equipment has been made where the flow of material has been facilitated by conveyors or augers, etc., such as U.S. Pat. No. 6,007,272 to Macku. In Macku, the apparatus enjoys a lower center of gravity.

While these approaches of using heated wall gravity-fed hopper pavers and low profile slat and remix machines have been used extensively in the past, they do have some drawbacks. First of all, the gravity-fed hopper often requires extra height to the hopper so as to allow the application of a significant amount of heat to the side of the hopper and to facilitate delivery of the hot mix asphalt (HMA) backwards to the screed. These heated wall gravity-fed hoppers could have significant disadvantages in stability, as well as often lower capacity and inconvenient HMA loading methods. Secondly, the low profile slat and remix machines require the use of some type of a conveyor because there is either no or insufficient slope in the hopper to cause the HMA to flow backwards. These low profile slat or remix machines require considerable cleanup owing to the propensity for HMA to stick to and remain on surfaces, especially the lower wall or floor of the HMA storage bin or hopper.

Consequently, there exists a need for improved methods and systems for deploying a low profile HMA machine with reduced labor associated with cleanup, especially cleanup of the floor of the hopper or bin. Also, some of the solvents typically used to clean up or to prevent sticking are environmentally unfriendly, such as the use of fuel oil or diesel fuel as a solvent. Often these solvents get into the ground and damage vegetation and can get into creeks and streams, and in extreme cases, into water tables.

SUMMARY OF THE INVENTION

It is an object of the present invention to provide a system and method for providing low profile HMA paving equipment tools with increased efficiency in cleanup.

It is a feature of the present invention to utilize a heated hopper floor in an HMA paving, remix or slat conveyor material transfer machine.

It is an advantage of the present invention to reduce the cost, effort and environmental impact associated with use, cleaning and maintaining low profile or flat bottom HMA hopper machines.

It is another advantage of the present invention to reduce the horsepower required to move materials in a remix or slat-equipped paver tractor.

It is another advantage of the present invention to reduce the wear on remix or slat-equipped paver tractor material conveying parts.

It is another feature of the present invention to mix engine exhaust with fumes recovered from HMA to produce useful heat.

It is yet another advantage of the present invention to generate, capture and utilize heat from burning the vapor emissions of HMA material in road building equipment.

The present invention is an apparatus and method for heating a floor of a hopper of an HMA road building machine, designed to satisfy the aforementioned needs, provide the previously stated objects, include the above-listed features, and achieve the already articulated advantages. The present invention is carried out in a "wasted heat producing fume-less" manner in a sense that waste of heat content or combustible material in HMA vapors from road building machines, has been reduced.

Accordingly, the present invention is a system and method including a road building machine which combines engine exhaust (the ignition source) and HMA vapors (the fuel) to burn to and thereby heat floors, halls or surfaces of road building equipment so as to reduce the amount of HMA which sticks to surfaces of the road building machines, together with the aforementioned advantages.

BRIEF DESCRIPTION OF THE DRAWINGS

The invention may be more fully understood by reading the following description of the preferred embodiments of the invention, in conjunction with the appended drawings wherein:

FIG. 6 is an alternate embodiment of the present invention shown in FIG. 1 where the augers 109 are replaced with a slat conveyor 609.

FIG. 7 is a perspective view of a rear end of a paver of the present invention which includes a screed.

DETAILED DESCRIPTION

Figure 1:
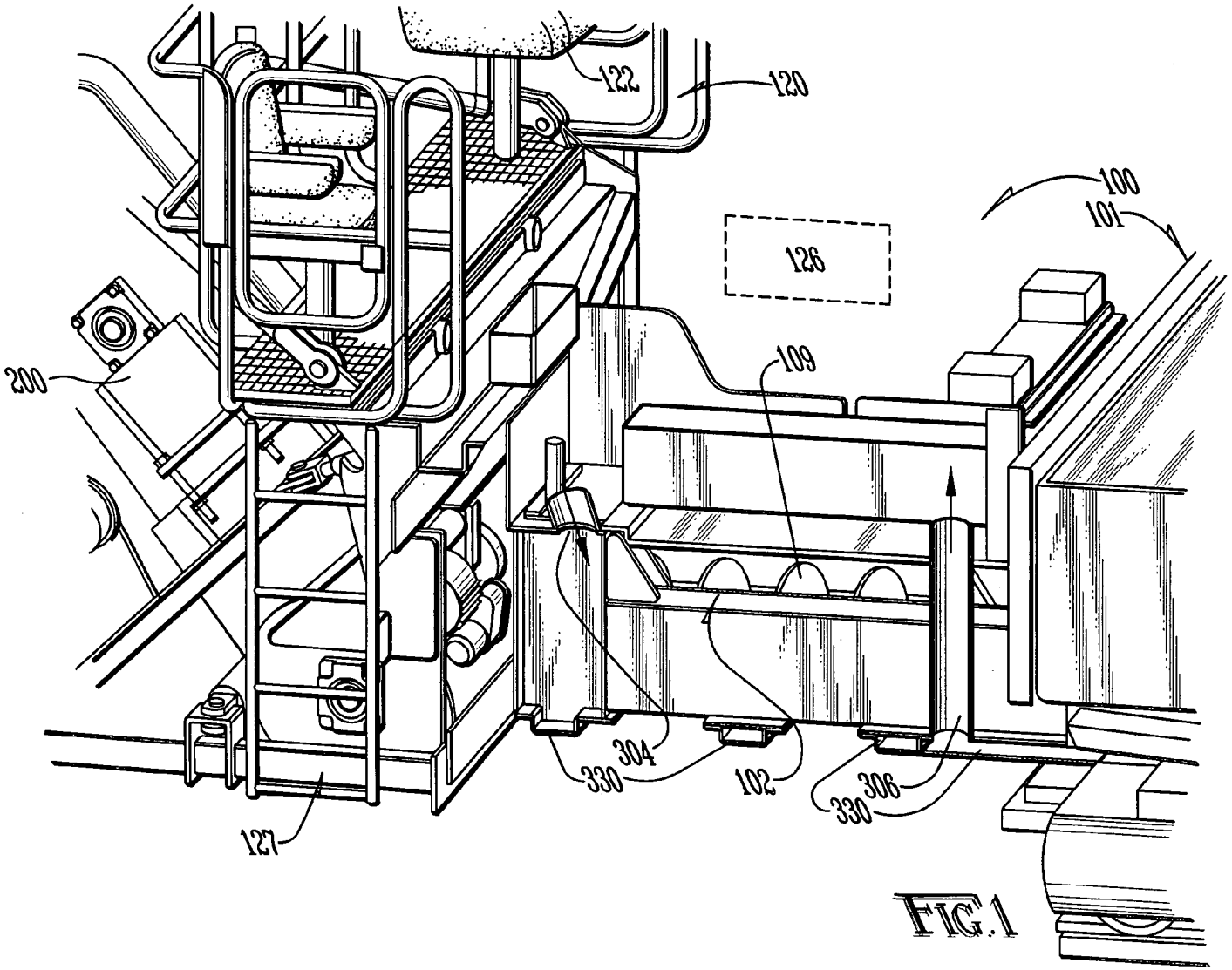
FIG. 1 is a perspective partially dismantled view of the heated floor hopper machine of the present invention, with partial cut-away portions or with items removed to expose underlying structure; the double arrows indicate direction of fume flow, and the dashed lines indicate the general area of the engine which has been removed to reveal underlying portion of the invention.
Figure 6:
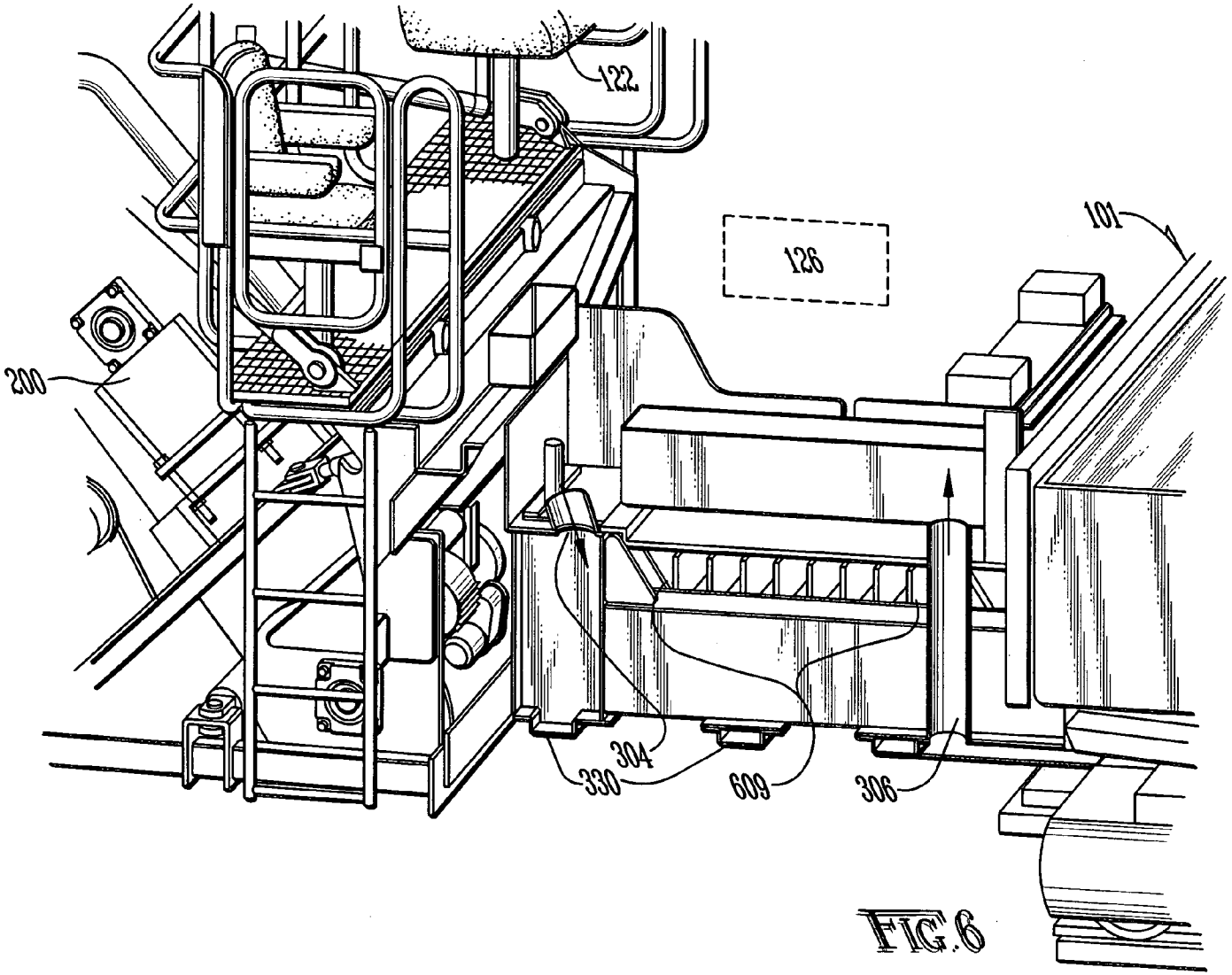
FIG. 6 is identical to FIG. 1 except that the augers 109 are replaced with a slat conveyor 609.
Figure 4:
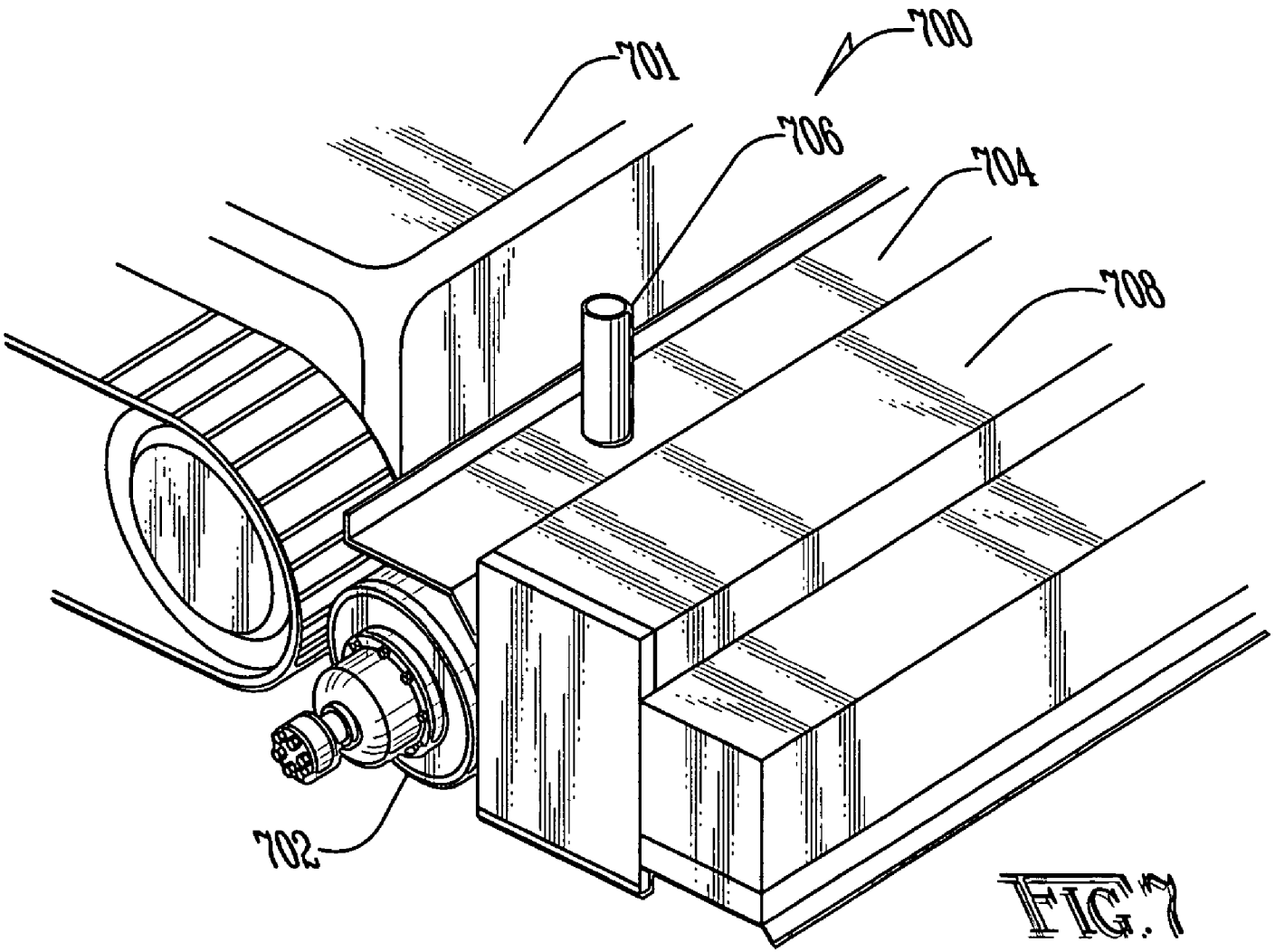

Now referring to the drawings wherein like numerals refer to like matter throughout, and more specifically referring to FIG. 1, there is shown a central section of an HMA fume/exhaust mix heated floor hopper machine of the present invention, generally designated 100, which includes a hopper and mixing apparatus 101, a conveying tunnel 102 (note that portions of the device have been removed to reveal underlying components), auger 109, driver station 120, driver seat 122, engine 126, shown as a dotted line because it has been removed from the figure to reveal underlining components. and chassis 127. Items 101, 102, 109, 122, 126 and 127 are preferably similar or identical to components of prior art remixing road pavers such as described in the above-referenced Macku U.S. patent and the prior art road paver manufactured by Cedarapids, Inc. of Cedar Rapids, Iowa. Engine 126 is drawn as a simple block, but it may include numerous related systems and/or components not limited to components of a hydraulic pump and system, an electrical system and other systems. The means for moving hot mix asphalt (HMA) from said hopper toward said rear end can be any type of arrangement, such as the conveying tunnel 102 (which extends beneath the engine 126) in combination with a plurality of re-mix augers 109, or it can be a slat conveyor (shown in FIG. 6) which also is disposed in the conveying tunnel 102 or still other ways. Throughout this discussion, reference may be made to an HMA hopper machine, remix machine or slat conveyor transfer machine or the like. It should be understood that the present invention is intended to apply to any HMA device which has an internal combustion engine and which has a surface which is desirable to heat so as to improve performance of the HMA and/or improve the interaction of the HMA with the surface.

Figure 2:
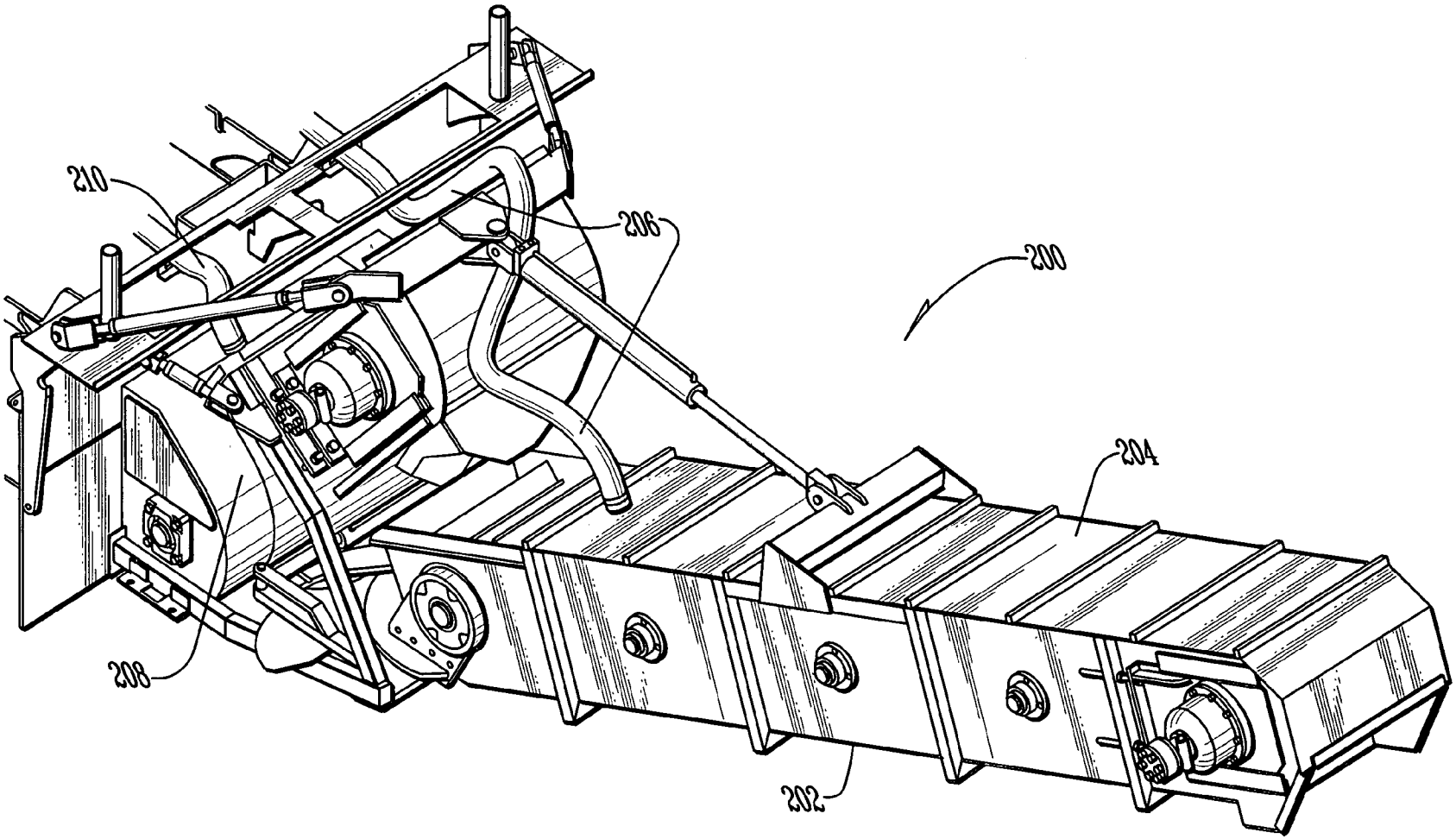
FIG. 2 is a view of a rear fume collection system of the present invention.

Now referring to FIG. 2, there is shown a rear portion of an HMA hopper machine of the present invention, together with an HMA fume collection system adapted for a rear-mounted HMA elevating conveyor 202. Rear-mounted HMA elevating conveyor 202 is shown with an elevating conveyor cover 204 and a vacuum fume collection hose 206 which extends from the enclosed areas about the rear-mounted HMA elevating conveyor 202 toward the HMA hopper machine. Also shown is a fume capturing shroud 208 and a vacuum fume collection hose 210, which are disposed at the rear of the HMA hopper machine. These HMA fume collection systems are believed to be representative of the numerous ways of capturing HMA fumes. Similar to FIG. 2 in its function of HMA fume collection is a screed version 700 as shown in FIG. 7. FIG. 7 shows a rear portion of a paver tractor 701 having a rear auger 702 which is disposed transversely so as to move material from the center out to the edges of the screed 708. Above the rear auger 702 is a fume collection hood 704 which is coupled to fume collection hose 706, which is similar to hose 206 of FIG. 2.

Figure 3:
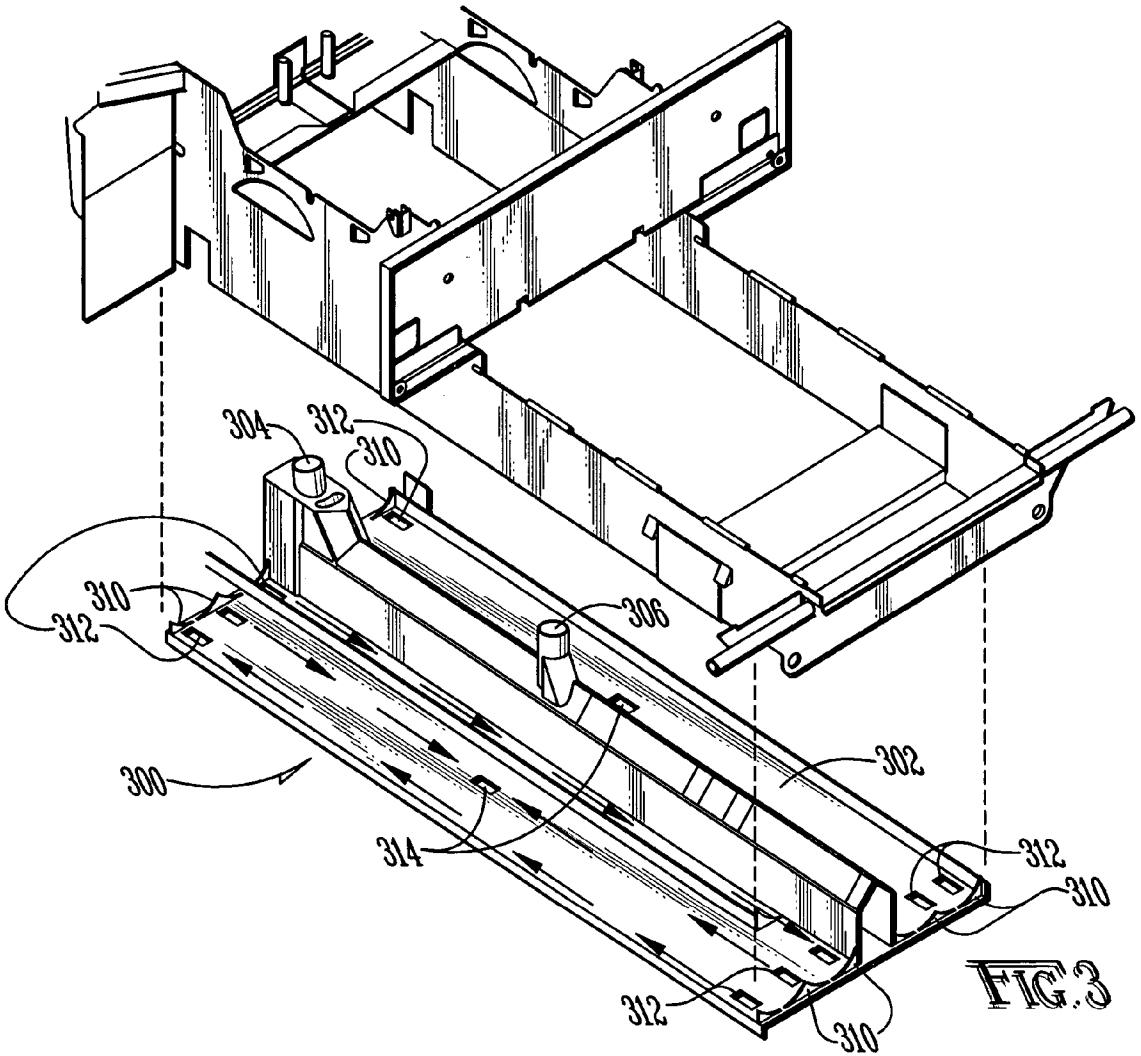
FIG. 3 is a perspective view of the heated floor portion of the present invention.

FIG. 3 is a perspective view of the heated floor of the present invention. The heated floor assembly 300 is intended to convey the details which could be used to implement a heated floor in an HMA hopper re-mix machine. It should be understood that slat conveyor-type HMA transfer machines, as well as any other type of HMA system, could be used, the re-mix type being selected here as being representative.

The heated floor assembly 300 has a heated floor bottom 302 which has a heated gas inlet end 304 at one end and a heated gas outlet end 306 disposed in the center. The gases, which are heated from engine exhaust and from the combustion of the HMA fumes, enter through heated gas inlet end 304 and proceed through either duct work 330 (FIG. 1) or other air passages to heated gas inlet ports 312 where the heat gas will flow into a cavity or chamber toward heated gas outlet ports 314 and then out heated gas outlet end 306. It should be understood that an infinite number of ways could be used to direct the airflow under, around and through any heated floor assembly. The one example shown here is intended to be representative of the many other arrangements which could be employed. In this exemplary embodiment, the heated gas inlet ports 312 are fed from beneath by ducts 330 (FIG. 1) extending outwardly from heated gas inlet end 304. The heated gas outlet ports 314 are ducted below to the heated gas outlet end 306, where the heat gases are allowed to escape. In both cases, the ducts 330 are disposed below the heated floor bottom 302 and are best shown in FIG. 1.

Figure 4:
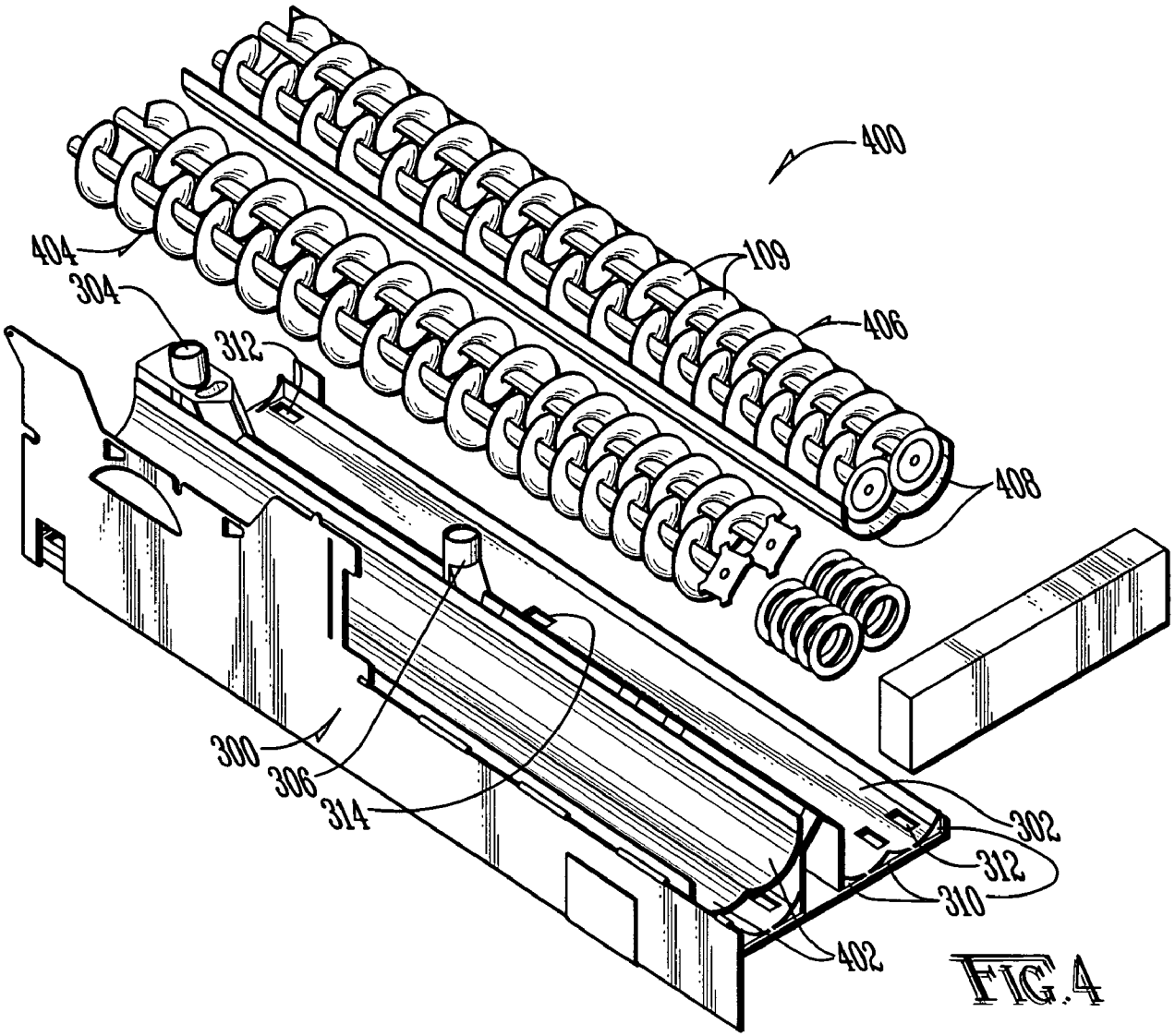
FIG. 4 is an exploded perspective view of the heated floor/auger combination of the front hopper portion of FIG. 1.

In a preferred embodiment of the present invention the ports 310, 312, and 314 are shown as rectangular holes with a transverse line in a mid section. This line is an end of a slider fume flow control gate which can be adjusted by the user to change the amount of flow through the port. In a preferred embodiment, the slider fume control gates are configured to cause the fumes to flow in a direction which is counter to the flow of the HMA by the augers 109 (FIGS. 1 and 4). This counterflow fume direction is preferred because it applies the hottest fumes to the coolest HMA being carried by the augers 109. However, in some situations, it may be desirable to use a parallel flow fume direction which can be accomplished by manipulation of the slider fume control gates. It should be understood that other forms of control of fumes through the port other than a slider gate could be utilized as well, such as valves, doors, etc.

The present invention may be more fully understood by now referring to FIG. 4, which shows a partially and differentially exploded view of the heated floor remix auger combination assembly 400 of the present invention.

There are shown four remix augers 109. The two augers labeled 404 are shown exploded from the curved auger elevated floor segments 402, while the two augers labeled 406 are shown exploded with the curved auger elevated floor segments 408 away from the heated floor bottom 302. End caps 310 are shown and serve to enclose the area above the heated floor bottom 302 and below the curved auger elevated floor segments 402 and 408. This is the cavity in which the heated air circulates and thereby heats the curved auger elevated floor segments 402 and 408 and thereby heats the HMA disposed in the hopper and mixing apparatus 101.

Figure 5:
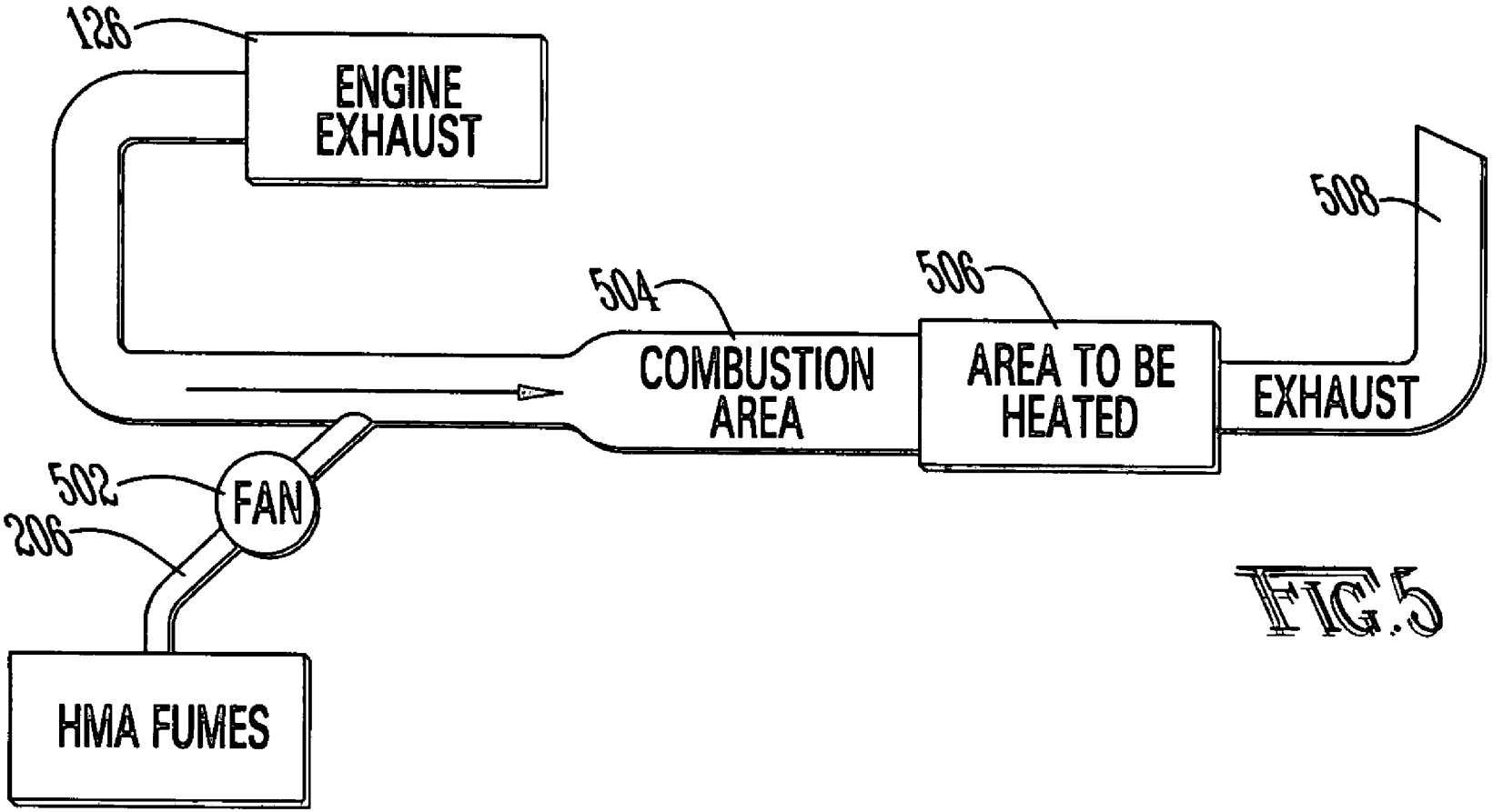
FIG. 5 is an exhaust/HMA fume fluid schematic of a circuit of the present invention.

Now referring to FIG. 5, there is shown a simplified diagram of the circuit of fluids used in the HMA heating process of the present invention.

There is shown a fume fan 502 which creates a vacuum and thereby pulls in fumes from the HMA via vacuum fume collection hose 206 or other hoses, etc. The HMA fumes are blown into an exhaust and HMA fume combination/combustion area 504 where engine exhaust from the engine ignites the HMA fumes and cause combustion and release of energy as heat. The now hotter mixture of exhaust and HMA fumes (post combustion) is blown into surface to be heated 506. This can be a heated floor cavity as described herein, or it can be any type of apparatus or assembly which can transfer heat from the burnt or possibly still burning HMA fumes into a surface which contacts HMA. The heating of the surface which contacts the HMA surface tends to heat the HMA itself and tends to reduce sticking of the HMA to the surface. Numerous reasons and approaches to heating the HMA or HMA contacting surfaces may be employed. Once the combusted or re-heated mixture of HMA fumes and exhaust transfers heat to the desired surface, it then can be exhausted to the exhaust pipe 508 to atmosphere.

In operation, the apparatus and method of the present invention as described in FIGS. 1-5 could function as follows:

Firstly, a hopper machine 100 is provided which accepts HMA in a hopper and mixing apparatus 101 and transports it rearward via conveying tunnel 102.

Fumes are collected off the HMA at the rear of the hopper machine or in any implement which is deployed behind the hopper machine and directed back toward the hopper. Exhaust from the engine 126 is collected and directed toward the hopper. The fumes from the HMA and the engine exhaust are mixed. Due to the high temperature of the engine exhaust, the fumes from the HMA burn, giving off heat.

This combustion of HMA fumes results in generation of more heat which is used to heat the floor of the hopper machine 100.

After the combustion occurs, the product heat and the engine exhaust vapors are circulated under the heated floor of the paver 100 where heat is transferred to the heated floor and the re-heat/combusted HMA and exhaust vapors exit the paver through exhaust pipe 508.

Throughout the above description, HMA is described as the material to be used. It should be understood that the present invention is directed to any type of road surface. It is believed that recycled asphalt products could be used, cold mix asphalt, and even in certain applications with any appropriate modifications, concrete could be the paving material. In some of these alternate or non-HMA materials, it should be noted that they may not produce or emit any combustible fumes. Hopper and mixing apparatus 101 may comprise a rectangular box or an angled rectangular or circular bin or any shaped container and material mixing and transfer apparatus which is suitable for the paving material being used. It is also contemplated that the floor of the hopper bin could be heated with a source other than engine exhaust and other than combustion of HMA fumes. An independent fuel or means for heating of air to be blown beneath the floor of the hopper bin is also contemplated.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A hopper machine comprising:

a chassis having a front end and a rear end;

a hopper disposed on said chassis at said front end;

a driver station comprising a driver seat and a steering wheel;

said driver station disposed on said chassis at said rear end;

an engine and drive train coupled to said hopper and configured to provide propulsion of said hopper, said chassis and said driver station when said hopper is filled with road paving material and said driver station is occupied by a driver;

means for moving hot mix asphalt (HMA) from said hopper toward said rear end;

means for collecting fumes from said HMA, and said HMA is moving within one of said hopper and said means for moving, and said fumes toward a location to be heated;

means for collecting exhaust from said engine and said exhaust toward said location to be heated; and means for directing hot gases into said location to be heated adjacent to HMA disposed in said hopper and thereby transferring heat, generated by combustion of said fumes, to said HMA.

2. A hopper machine of claim 1 further comprising a discrete combustion chamber for mixing said fumes with said exhaust and burning said fumes prior to directing hot oases to a location adjacent to said HMA.

3. A method of heating a portion of a piece of road paving equipment comprising the steps of:

providing a source of HMA;

collecting fumes from said HMA while said HMA is in motion;

igniting said fumes to generate heat; and transferring heat, generated burning said fumes, to a metal surface which is in contact with said HMA.

4. A method of claim 3 wherein said step of igniting said fumes comprises mixing, with said fumes from HMA, exhaust from an internal combustion engine and said step of transferring heat further comprises adding heat provided by said exhaust from an internal combustion engine to said metal surface.

5. A method of claim 3 wherein said step of transferring heat comprises the steps of:

causing heated vapors to move through and then exit from a chamber disposed adjacent to a portion of a material storage bin.

6. A method of claim 5 wherein said chamber is disposed beneath a portion of said material storage bin and said chamber further comprises a plurality of adjustable fume flow control limiters.

7. A method of claim 6 wherein said adjustable fume flow control limiters are sliding gates selectively covering portions of ports in said chamber so as to permit a change in flow direction of said heated vapors from a direction which is counter to a direction of flow of material in said material storage to a direction which is parallel to a direction of flow.

8. A method of claim 3 wherein said metal surface is a component of a re-mix hopper machine.

9. A method of claim 8 wherein said re-mix hopper machine further comprises a screed.

10. A method of claim 5 wherein said chamber is disposed beneath a floor of a hopper.

11. A method of claim 5 wherein said step of igniting is done without the use of a dedicated fume ignition device disposed in a path of vapors moving away from an HMA fume collection means and toward an exhaust port of said chamber.

12. An apparatus for heating HMA comprising:

a device for moving HMA from a location on a road construction apparatus, which device is at least partially shrouded so as to aid in capturing fumes emanating from the HMA while said HMA remains on-board said road construction apparatus;

a first vent configured to direct gases originating from said device toward and into contact with a surface, on-board said road construction apparatus, at which HMA is heated; and a second vent configured to direct exhaust originating from an internal combustion engine toward a location where heat from said exhaust causes ignition of said fumes, thereby generating additional heat, beyond any pre-existing heat of said fumes and any pre-existing heat of said exhaust.

13. An apparatus of claim 12 wherein said device is an auger.

14. An apparatus of claim 12 wherein said device is a conveyor.

15. An apparatus of claim 12 wherein said surface is a portion of a hopper.

16. An apparatus of claim 12 wherein said surface is a non-horizontal piece of metal.

17. An apparatus of claim 12 further comprising a chamber located beneath the surface which comprises a floor of a hopper.

18. An apparatus of claim 17 further comprising a conveyor used to move HMA to a location behind a front of said hopper.

19. An apparatus of claim 17 further comprising an auger used to move HMA to a location behind said hopper.

20. An apparatus of claim 12 wherein said road construction equipment is an HMA re-mix machine.

21. An apparatus of claim 20 further comprising an auger configured to move HMA from said hopper to a location behind said hopper.

22. An apparatus of claim 21 further comprising a shrouded conveyor entirely disposed behind said hopper for moving HMA to a location behind said hopper and to gather fumes from said HMA as it is moved by said shrouded conveyor.

23. A re-mix hopper machine comprising:

a road paving material container;

a means for moving road paving material located inside said road paving material container toward a location behind a front of said road paving material container;

said road paving material container having a bottom, above which said road paving material is located;

a hot fluid circulation system disposed beneath said road paving material and configured to facilitate heat conduction through said bottom and into said road paving material inside said road paving material container;

a source of hot fluid for circulation through said hot fluid circulation system; and wherein said source of hot fluid comprises a means for collecting fumes from road paving material while said road paving material remains disposed within one of said road paving material container and said means for moving road paving material.

24. A machine of claim 23 wherein said hot fluid is a gas, said means for moving road paving material is a plurality of augers, and said road paving material is hot mix asphalt.

25. A machine of claim 23 wherein said source of hot fluid is a combusted mixture of exhaust from an internal combustion engine and fumes collected from hot mix asphalt.

26. A machine of claim 23 wherein said bottom is a component of said hot fluid circulation system.

27. A machine of claim 23 wherein said bottom comprises a non-flat segment.

* * * * *

UNITED STATES PATENT AND TRADEMARK OFFICE

CERTIFICATE OF CORRECTION

PATENT NO. : 7,300,225 B2
APPLICATION NO. : 10/906958
DATED : November 27, 2007
INVENTOR(S) : Joseph E. Musil It is certified that error appears in the above-identified patent and that said Letters Patent is hereby corrected as shown below:

In Claim 1, column 5, line 53, please insert the word --directing-- after the word "and".

In Claim 1, column 5, line 55, please insert the word --directing-- after the word "and".

In Claim 2, column 5, line 64, please delete the word "oases" and insert therefor the word --gases--.

Signed and Sealed this

Eighth Day of July, 2008

JON W. DUDAS
*Director of the United States Patent and Trademark Office*